US006579077B1

(12) United States Patent
Bostwick et al.

(10) Patent No.: US 6,579,077 B1
(45) Date of Patent: Jun. 17, 2003

(54) DEEP WELL SUBMERSIBLE PUMP

(75) Inventors: Peter K. Bostwick, Maryland Heights, MO (US); Donald E. Morgan, Florissant, MO (US)

(73) Assignee: Emerson Electric Company, St. Louis, MO (US)

( * ) Notice: Subject to any disclaimer, the term of this patent is extended or adjusted under 35 U.S.C. 154(b) by 0 days.

(21) Appl. No.: 10/034,027

(22) Filed: Dec. 27, 2001

(51) Int. Cl.[7] ..... F04B 17/00; F04B 35/00; F04B 34/02; F04B 39/06

(52) U.S. Cl. ..... 417/366; 417/423.1; 417/423.3

(58) Field of Search ..... 417/423.1, 423.3, 417/423.14, 366

(56) References Cited

U.S. PATENT DOCUMENTS

| | | | | |
|---|---|---|---|---|
| 2,737,120 | A | 3/1956 | Ivanoff et al. | 103/87 |
| 2,910,005 | A | 10/1959 | Angell et al. | 103/87 |
| 2,942,555 | A | 6/1960 | Pezzillo | 103/87 |
| 2,968,249 | A | 1/1961 | Caine et al. | 103/87 |
| 3,115,839 | A | 12/1963 | Pollak et al. | 103/87 |
| 3,704,078 | A | 11/1972 | Conery et al. | 417/369 |
| 4,019,836 | A | 4/1977 | Deters | 417/360 |
| 4,115,038 | A | 9/1978 | Litzenberg | 417/357 |
| 4,181,473 | A | 1/1980 | Ina | 417/365 |
| 4,212,601 | A | 7/1980 | Ina | 417/365 |
| 4,213,745 | A | 7/1980 | Roberts | 417/363 |
| 4,320,431 | A | 3/1982 | Bell | 361/23 |
| 4,445,820 | A | 5/1984 | Hayashi et al. | 417/366 |
| 4,834,623 | A | 5/1989 | Triolo et al. | 417/366 |
| 5,129,795 | A | 7/1992 | Hyland | 417/423.12 |
| 5,181,837 | A | 1/1993 | Niemiec | 417/350 |
| 5,201,848 | A | 4/1993 | Powers | 415/199.1 |
| 5,261,796 | A | 11/1993 | Niemiec et al. | 417/371 |
| 5,348,452 | A | 9/1994 | Yamamoto et al. | 417/422 |
| 5,378,121 | A | 1/1995 | Hackett | 417/363 |
| 5,385,444 | A | 1/1995 | Kobayashi et al. | 415/182.1 |
| 5,388,971 | A | 2/1995 | Kobayashi et al. | 417/423.14 |
| 5,478,215 | A | 12/1995 | Kobayashi et al. | 417/423.14 |
| 5,494,403 | A | 2/1996 | Kobayashi et al. | 415/182.1 |
| 5,549,447 | A | 8/1996 | Bevington | 415/115 |
| 5,674,056 | A | 10/1997 | Yamamoto et al. | 417/366 |
| 5,692,886 | A | 12/1997 | Kobayashi et al. | 417/423.12 |
| 5,700,138 | A | 12/1997 | Bevington | 417/366 |
| 5,890,880 | A | 4/1999 | Lustwerk | 417/366 |
| 6,010,319 | A | 1/2000 | Moon | 407/423.14 |
| 6,012,909 | A | 1/2000 | Sloteman et al. | 407/366 |

(List continued on next page.)

*Primary Examiner*—Charles G. Freay
*Assistant Examiner*—William H. Rodriguez
(74) *Attorney, Agent, or Firm*—Thompson Coburn, LLP

(57) ABSTRACT

A deep well submersible pump has a pump housing containing an electric motor. The motor is radially spaced from the pump housing interior surface defining an annular channel through the pump housing from an inlet opening to an outlet opening of the housing. The motor is mounted on a cowling that has an exterior surface. A plurality of deswirler blades extend between the pump housing interior surface and the cowling exterior surface. As the deswirler blades extend through the housing interior, a spacing between the-cowling exterior surface and the housing interior surface expands radially. The cowling exterior surface and the pump housing interior surface define an annular liquid flow path that is first directed radially outward from the inlet opening and then curves around the cowling and is directed axially through the deswirler blades to the annular channel between the motor and the pump housing interior surface. An impeller mounted on the motor shaft has axially spaced inner and outer disks with a plurality of radiating vanes between the disks. The outer disk has a center hole with an annular rim surface in sealing engagement with the inlet cap and a peripheral surface in sealing engagement with the inlet cap. The impeller inner disk has a peripheral surface in sealing engagement with the cowling. Rotation of the impeller draws liquid through the inlet cap opening and pushes the liquid through the pump flow path.

35 Claims, 5 Drawing Sheets

U.S. PATENT DOCUMENTS 6,092,595 A 7/2000 Fecht et al. ..... 166/68
6,162,015 A 12/2000 Nagai et al. ..... 415/199.2
6,203,275 B1 3/2001 Kobayashi et al. ..... 415/199.2
6,244,835 B1 * 6/2001 Antaki et al. ..... 417/356
6,293,769 B1 * 9/2001 Radermacher et al. ..... 417/357
6,419,460 B1 * 7/2002 Dantlgraber ..... 417/366
6,447,265 B1 * 9/2002 Antaki et al. ..... 417/354
6,474,981 B1 * 11/2002 Morgan ..... 431/350

* cited by examiner

DEEP WELL SUBMERSIBLE PUMP

BACKGROUND OF THE INVENTION (1) Field of the Invention

The present invention pertains to a deep well submersible pump, and in particular a deep well submersible pump construction that employs fewer pump stages than prior art deep well pumps, resulting in reduced materials cost and easier assembly of the pump.

(2) Description of the Related Art

Deep well submersible pumps are employed in pumping liquids such as water from deep well holes having relatively small bore diameters. Pumps of this type are specially built for their environment and typically include a centrifugal pump having a series of vertically stacked radial impellers driven by an electric motor. The entire pump construction is dimensioned to enable the pump to be lowered into a well and suspended in the liquid at the bottom of the well by a series of interconnected downpipes. One example of a current design of a deep well pump consists of twenty stages, i.e. twenty impellers, and a motor driving the impeller stages at 3,600 RPM.

This pump assembly measures 36 inches in length and 3.5 inches in diameter. Some pump designs have also employed electric motors that operate at greater speeds, for example 12,000 RPM, to reduce the number of impeller stages while obtaining the same performance. Pumps of this type typically employ three or four stages or impellers to obtain the desired performance. Both the impellers and the liquid return channels of these prior art pumps are of the radial type.

Deep well submersible pumps have limited diameter dimensions so that they can be operated in well bores of only 4–5 inches in diameter. The pump is mounted in the bottom downpipes of a series of downpipes suspending the pump in the well bore with the electric motor of the pump being oriented vertically. The impellers of the pump are mounted on the vertically oriented shaft of the motor in vertically spaced relative positions. On rotation of the motor shaft, the impellers draw liquid into the pump housing and force or push the liquid centrifugally outward and upward through the impeller and return channel stages, thereby lifting the liquid through the pump housing and the series of downpipes to the surface opening of the well.

Due to the multiple stages of impellers and return channels employed in current designs of deep well submersible pumps, considerable time and effort is needed to assemble the pumps. In addition, increasing the impeller and return channel stages of a pump increases its weight. The increased weight of a pump often requires the use of metal downpipes with increased side wall thicknesses to lower the pumps and suspend the pumps in the liquid at the bottom of the well, thereby further adding to the overall weight of the pump and its downpipes. The increased number of pump stages and the increased size of the pump downpipes also result in increasing the cost of the pump assembly. Furthermore, in order to obtain different performance levels from a pump assembly, it is often necessary to assemble different numbers of stages with different numbers of impellers and return channels or use a different family of impellers and return channels.

A more simplified pump construction that reduces the number of component parts of the pump and thereby reduces the weight of the pump and yet is capable of operating in a range of desired performance levels would overcome the disadvantages associated with prior art deep well submersible pumps.

SUMMARY OF THE INVENTION

The deep well submersible pump of the invention overcomes disadvantages associated with prior art deep well submersible pumps by providing a single stage 12,000 or higher RPM pump of simplified construction. The pump is designed to use only a single stage and is basically comprised of a radial impeller and an axial diffuser/deswirler in the pump housing.

The pump housing is comprised of a cylindrical side wall with axially opposite ends surrounding an interior volume of the housing. An inlet end of the side wall is covered by an inlet cap having a centered inlet opening and the axially opposite outward end of the side wall is covered by an outlet cap having a centered outlet opening.

An electric motor is contained in the side wall with a shaft of the motor projecting axially toward the inlet opening of the inlet cap. The exterior surface of the motor casing is spaced, radially inward from the side wall interior surface, defining an open annular channel between the casing exterior surface and the side wall interior surface.

A tubular cowling is mounted on the motor casing adjacent the inlet cap. The cowling has an annular shoulder surface adjacent the inlet cap. The tubular cowling has an exterior surface that, together with the interior surface of the inlet cap and the interior surface of the side wall, defines an annular flow path that extends radially away from the inlet opening of the inlet cap and then curves and extends axially between the cowling exterior surface and the inlet cap and side wall interior surfaces. As the flow path extends axially between the cowling exterior surface and the side wall interior surface, the radial spacing between these two surfaces increases.

In addition, deswirl or a reduction in the swirl of the flow is provided by a plurality of circumferentially spaced blades between the cowling exterior surface and the side wall interior surface. Each blade has opposite inlet and outlet ends that are spaced axially from each other. The inlet ends of the blades are oriented in generally circumferential directions relative to the cowling and side wall and the trailing ends of the blades are oriented in generally axial directions relative to the cowling and side wall.

The interior surface of the inlet cap has a peripheral portion that extends radially outwardly away from the inlet opening of the cap and then curves continuously toward the side wall and extends axially and merges as a continuous surface with the interior surface of the side wall. An annular shoulder is formed in the interior surface radially inward of the peripheral portion of the cap interior surface and axially opposite the cowling annular shoulder. The inlet cap inlet opening is surrounded by a flat, annular rim surface on the cap interior surface.

The impeller of the pump is mounted on the motor shaft and is comprised of an axially inner disk and an axially outer disk that are spaced from each other by a plurality of impeller vanes between the disks. The axially outer disk has a center hole surrounded by a flat, annular rim surface. The flat, annular rim surface mates in sliding engagement with the flat, annular rim surface of the inlet cap inlet opening, thereby providing a sealing engagement between the two rim surfaces. The axially outer disk also has a flat, annular peripheral edge surface that opposes the annular shoulder on the inlet cap interior surface, thereby providing an additional seal between the outer disk and the inlet cap. The axially inner disk has a flat, annular peripheral edge surface that radially opposes the annular shoulder surface of the cowling and thereby provides a sliding seal between the inner disk and the cowling. The plurality of impeller vanes are circumferentially spaced around the axially spaced inner and outer disks. Each blade has an inner end adjacent the outer disk center hole and a radially opposite outer end adjacent the annular peripheral edge surfaces of the inner and outer disks.

On operation of the pump motor, the impeller is rotated drawing liquid from the well vertically upward through the inlet cap inlet opening and the outer disk center hole into the spacing between the impeller inner and outer disks. The impeller vanes then push or force the liquid radially outward toward the flow path defined between the cowling exterior surface and the interior surfaces of the inlet cap and side wall. The curved surface of the inlet cap interior surface peripheral portion turns the flow of liquid axially and directs the liquid through the blades of the axial diffuser/deswirler which direct the liquid flow through the annular channel between the motor casing exterior surface and the side wall interior surface. The liquid continues through the annular channel to the outlet end cap where it exists the pump interior volume through the outlet cap outlet opening.

The simplified construction of the deep well submersible pump of the invention reduces assembly time and the costs associated therewith, and reduces material costs significantly by reducing the number of stages of the pump. Using higher speeds allows the use of smaller motors which also significantly reduces the weight of the pump, enabling the pump to be used with plastic downpipes suspending the pump in the well which further reduces the overall weight of the pump assembly. The construction of the pump also enables the use of a smaller motor which also contributes to the reduction of manufacturing costs and the reduction of weight. With the desired type of motor employed in the pump, the speed of the pump can be varied to obtain different performance levels and a single pump may be employed to obtain a wide range of operating levels instead of adding stages or changing motors as was required with prior art deep well submersible pumps.

DESCRIPTION OF THE DRAWINGS

Further features of the invention are revealed in the following detailed description of the preferred embodiment of the invention and in the drawing figures, wherein.

DETAILED DESCRIPTION OF THE PREFERRED EMBODIMENT

Figure 1:
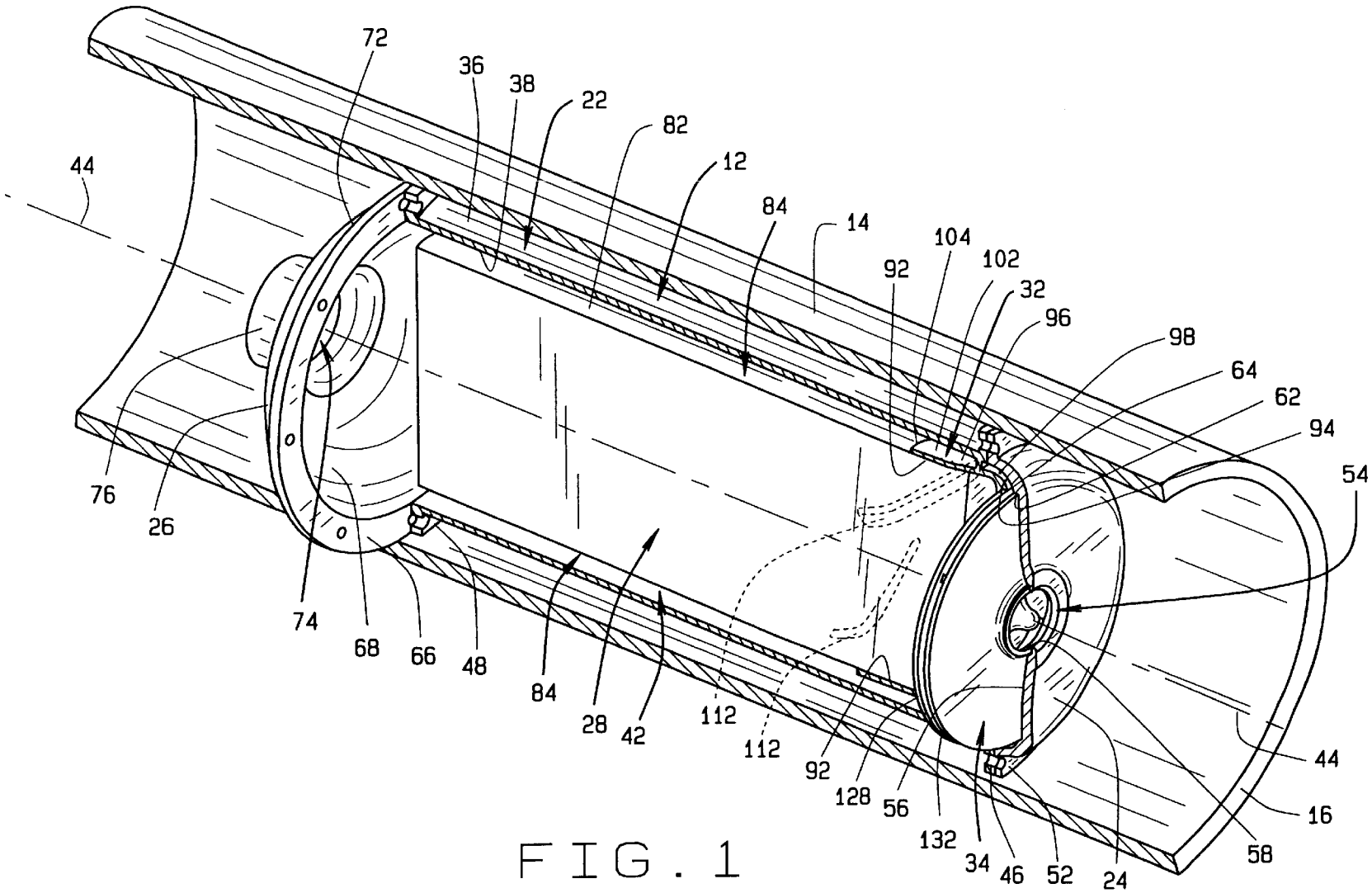
FIG. 1 is a partial sectioned view of the deep well submersible pump of the invention contained in a section of a well liner.

The deep well submersible pump 12 of the invention is shown installed inside a section of a well liner pipe 14 in FIG. 1. The well liner 14 has been sectioned to show the pump 12 which has also been sectioned to show interior components of the pump construction. In use of the pump 12, the pump would be at the bottom of a series of downpipes connected end-to-end. The series of downpipes are suspended in a well hole with the pump 12 connected to and suspended in the well liner at the bottom of the series of interconnected downpipes. In use of the pump 12, at least the bottom end of the suspended pump 12 would be submerged. As shown in FIG. 1, the basic component parts of the deep well submersible pump 12 of the invention include a cylindrical side wall 22, a circular inlet cap 24 and a circular outlet cap 26 that comprise the housing of the pump, an electric motor 28 contained in the housing, a cowling 32 mounted on the motor and the pump impeller 34 contained in the housing interior adjacent the inlet cap 24. The component parts of the pump 12 may be constructed of metals and/or plastics, depending on the particular performance levels desired of the pump which will determine the materials used in its construction as well as the material used in constructing the downpipe.

Figure 2:
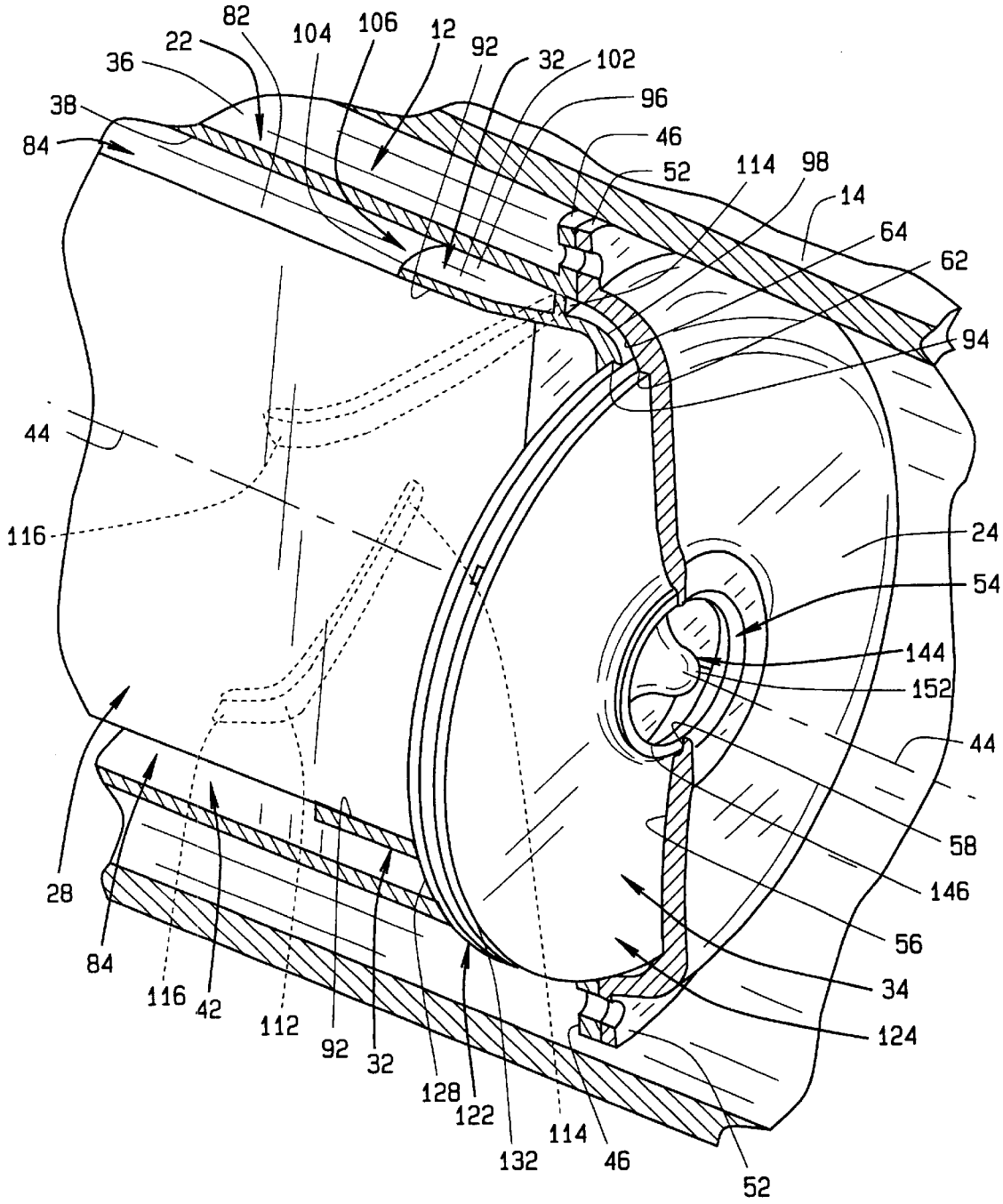
FIG. 2 is an enlarged partial view of the inlet end of the pump shown in FIG. 1.

The side wall 22 of the housing has a cylindrical exterior surface 36 and an opposite cylindrical interior surface 38 that surrounds an interior volume 42 of the pump housing. The cylindrical interior surface 38 of the side wall has a center axis 44 that defines mutually perpendicular axial and radial directions relative to the pump 12. The side wall has an annular inlet end flange 46 extending around an inlet end of the side wall and an annular outlet end flange 48 extending around an axially opposite end of the side wall. As shown in FIGS. 1 and 2, the side wall flanges 46, 48 are dimensioned to fit loosely inside the series of interconnected well liners so that the pump 12 can slide easily down the well.

The circular inlet cap 24 has an annular flange 52 at its outer periphery that is connected to the inlet end flange 46 of the side wall 22 in attaching the inlet cap 24 to the inlet end of the side wall. The inlet cap flange 52 is attached to the side wall inlet end flange 46 by threaded fasteners (not shown) or other equivalent means. The inlet cap has a circular inlet opening 54 at its center that is coaxial with the side wall center axis 44. The interior surface 56 of the inlet cap that faces toward the side wall interior volume 42 is provided with a flat, annular rim 58 that circles the cap center opening 54. The inlet cap interior surface 56 extends radially outward from the flat, annular rim surface 58 to an annular shoulder surface 62 formed in the inlet cap interior surface. The annular shoulder surface 62 is parallel with the side wall center axis 44. A peripheral portion 64 of the inlet cap interior surface extends radially away from the annular shoulder surface 62 and gradually curves toward the side wall interior volume 42 and extends axially. Where the inlet cap 24 attaches to the cylindrical side wall 22, the interior surface peripheral portion 64 of the cap merges as a continuous surface with the side wall interior surface 38.

The outlet cap 26 also has an annular flange 66 around its outer periphery that attaches to the side wall outlet end flange 48 in attaching the outlet cap 26 to the side wall 22. The outlet cap flange 66 can be attached to the side wall outlet end flange 48 by threaded fasteners (not shown) or other equivalent means. The outlet cap 26 has a dome shape with opposite interior 68 and exterior 72 surfaces and a center outlet opening 74 that is coaxial with the housing side wall center axis 44. A cylindrical collar 76 extends around the outlet opening 74. The collar 76 can be connected to separate downpipes or conduits for suspending the pump in the well and conducting liquid pumped through the pump housing.

The electric motor 28 in the illustrated embodiment is preferably a motor that is capable of operating at 12000

RPM. However, depending on the particular operative environment in which the pump 12 will be employed, the characteristics of the motor 28 will change. Because the particulars of the construction of the motor 28 are not important to the invention, the motor is schematically shown in the drawing figures as a cylindrical block that has been cut in half to provide a better view of the component parts of the pump 12. The motor is contained inside a cylindrical casing having an exterior surface 82 that is radially spaced from the interior surface 38 of the housing side wall 22. These relative dimensions of the motor casing exterior surface 82 and the housing side wall interior surface 38 define an annular channel 84 between the exterior surface and interior surface that extends the entire length of the motor and communicates with the inlet opening 54 of the inlet cap 24 and the outlet opening 74 of the outlet cap 26. A motor shaft 86 projects axially from the motor toward the inlet cap inlet opening 54.

Figure 3:
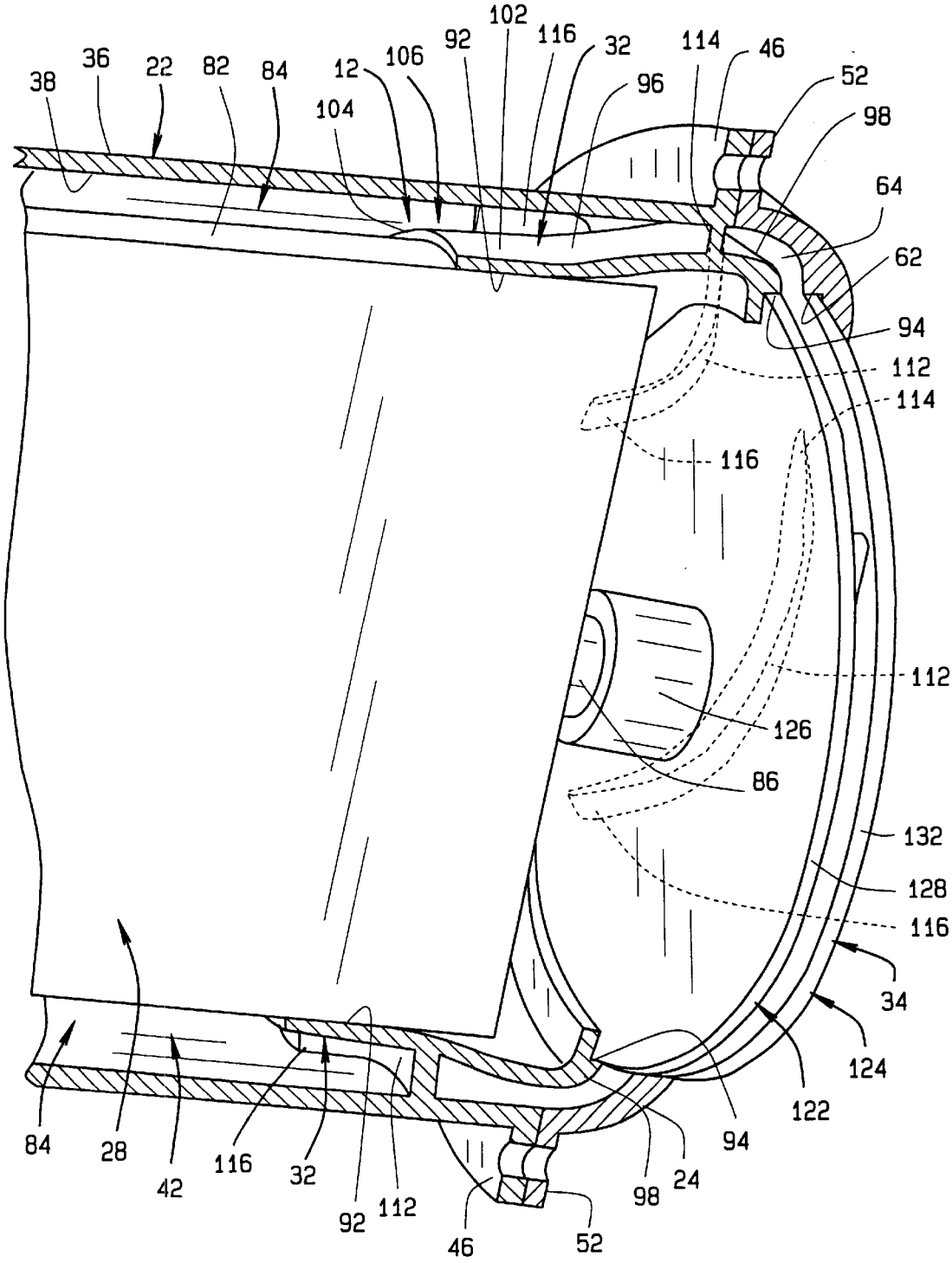
FIG. 3 is an enlarged partial view of the inlet end of the pump shown in FIG. 1 from the point of view of the outlet end of the pump.
Figure 5:
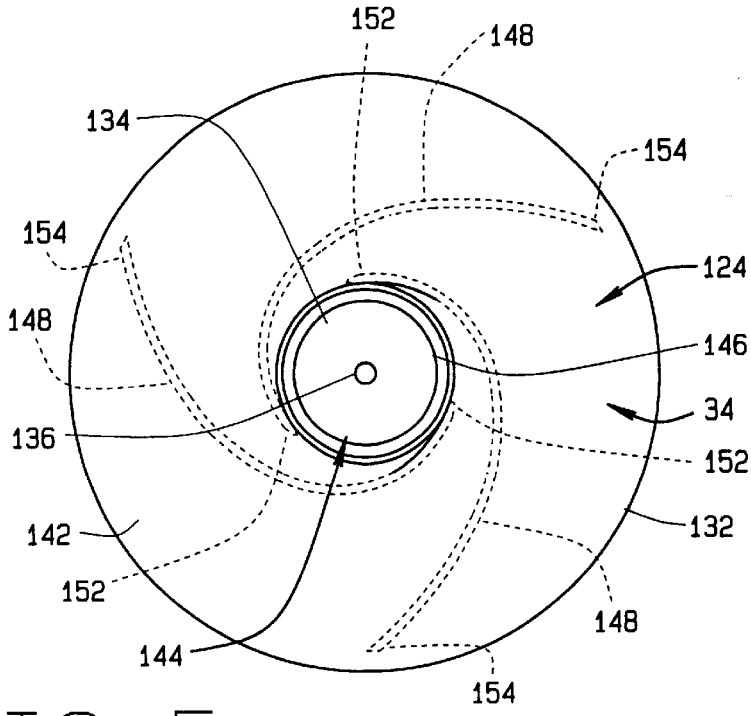
FIG. 5 is an inlet end view of the pump impeller.
Figure 4:
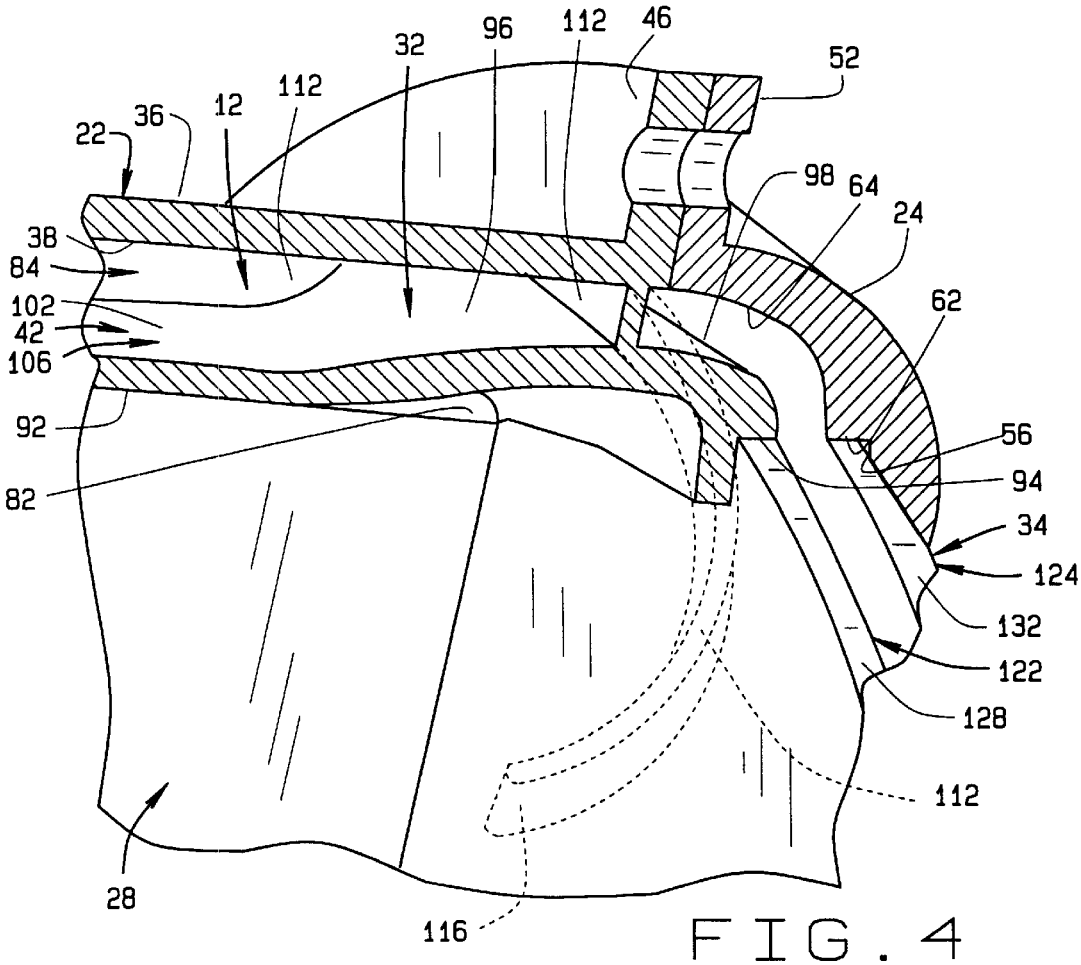
FIG. 4 is an enlarged partial view showing details of the pump construction of FIG. 3.
Figure 7:
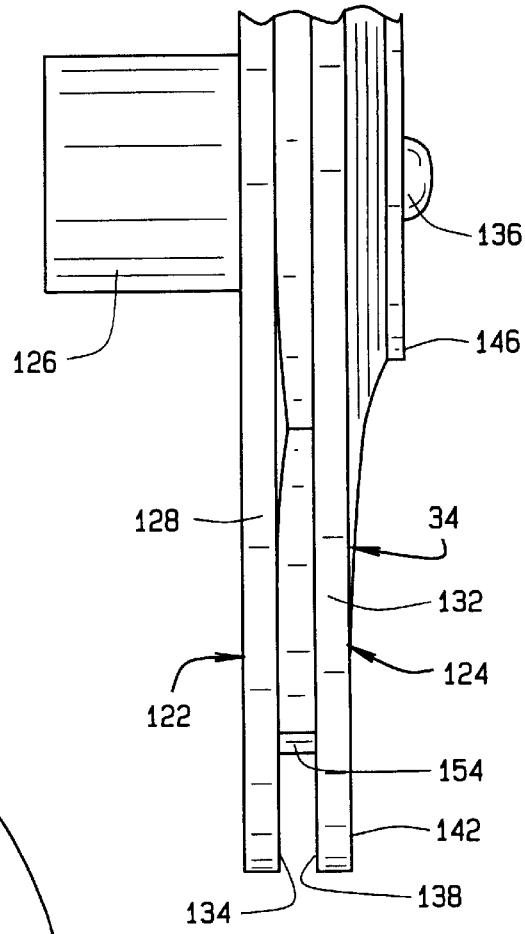
FIG. 7 is a partial enlarged view of the side of the impeller.
Figure 6:
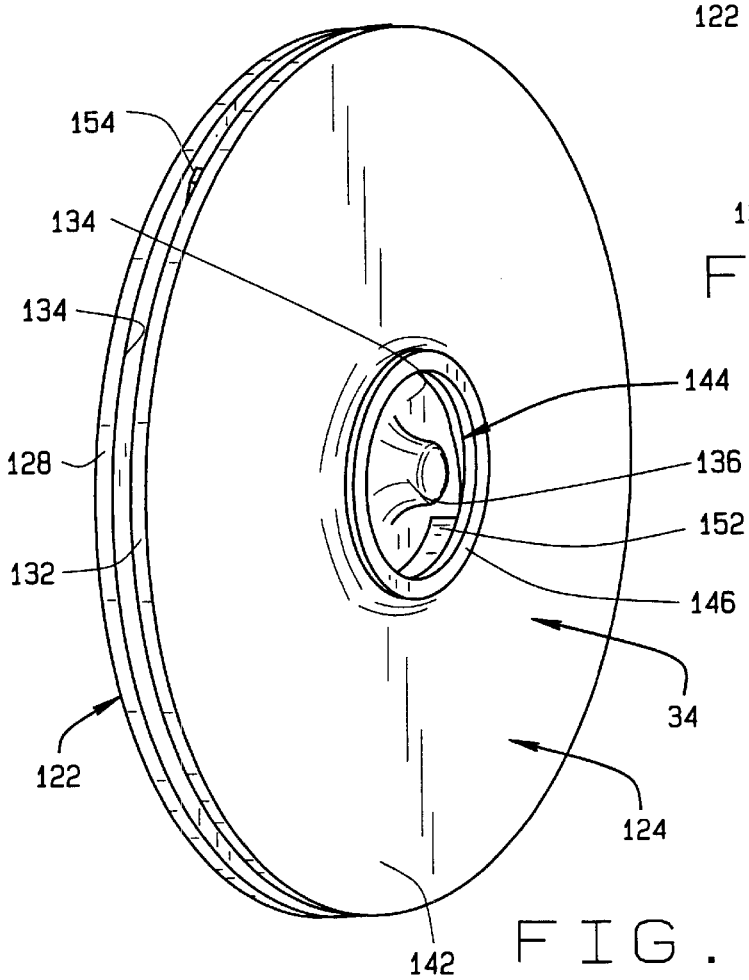
FIG. 6 is a perspective view of the inlet end of the impeller.

The motor 28 is, supported in the housing interior volume 42 by the cowling 32. The cowling 32 has a general cylindrical shape and is mounted on the motor adjacent the inlet cap 24. The cowling has an interior surface 92 that engages around the motor casing exterior surface 82 in mounting the cowling on the motor. A forward end of the cowling adjacent the inlet cap 24 has a flat, annular shoulder surface 94 that extends completely around the cowling forward end. As best seen in FIGS. 2–4, the annular shoulder surface 94 of the cowling is axially opposite the annular shoulder surface 62 of the inlet cap 24 and is also parallel to the housing center axis 44. The cowling exterior surface 96 is spaced axially from the inlet cap interior surface 56 and is spaced radially from the housing side wall interior surface 38. From the flat, annular shoulder surface 94 of the cowling the exterior surface 96 extends radially outwardly in an axially spaced relationship to the inlet cap interior surface 56 and then gradually curves toward the housing sidewall interior volume 42 following the curvature of the inlet cap interior surface peripheral portion 64. The curved portion 98 of the exterior surface 96 gradually turns into an axially extending portion 102 of the surface that extends to a rearward edge 104 of the cowling axially opposite the annular shoulder surface 94 of the cowling. As the axially extending portion 102 of the cowling exterior surface 96 extends toward the cowling rearward edge 104, a curvature formed in the cowling causes the exterior surface axial portion 102 to extend radially away from the housing side wall interior surface 38. This configuration of the cowling 32 results in the radial spacing 106 between the cowling exterior surface axial portion 102 and the housing side wall interior surface 38 becoming larger as the cowling and side wall extend axially away from the inlet cap 24. The configurations of the cowling exterior surface 96 and the inlet cap interior surface 56 and side wall interior surface 38 together define an annular flow path through the pump from the inlet opening 54 to the annular channel 84 where liquid directed through the flow path is first directed radially outward between the cowling exterior surface 96 and the inlet cap interior surface 56 and then turns around the cowling and the peripheral portion 64 of the inlet cap interior surface and is directed axially between the axial portion 102 of the cowling exterior surface 96 and the housing side wall interior surface 38 to the annular channel 84.

A plurality of deswirl blades 112 extend between the housing side wall interior surface 38 and the axial portion 102 of the cowling exterior surface 96. The diffuser blades 112 are circumferentially spaced around the cowling with each blade having a leading edge 114 adjacent the inlet cap 24 and an axially opposite trailing edge 116. To avoid obstructing the view of other component parts of the pump 12, some of the diffuser blades 112 and portions of the diffuser blades 112 are shown in dashed lines in FIGS. 1–4. The blades 112 join the cowling exterior surface 96 to the housing side wall interior surface 38. The leading edges 114 of the blades are positioned adjacent the curvature of the cowling exterior surface 96 where the exterior surface transitions from a radial direction to an axial direction. The leading edges 114 are oriented in a generally circumferential direction. The leading edges are angled slightly from the circumferential direction toward the inlet cap 24. From the leading edges 114, the blades gradually curve from the generally circumferential direction orientation of the blades to a generally axial direction orientation of the trailing edges 116. Each blade is given a shape designed to deswirl the fluid flow with the trailing edge 116 of the blade given an angle to cause the flow to exit axially or close to axially from the blade. Each of the blades 112 extends between the housing side wall interior surface 38 and the cowling exterior surface 96 along their entire lengths.

The impeller 34 is comprised of an axially inner disk 122 and an axially outer disk 124 that are mounted by a hub or collar 126 to the motor shaft 86 in a conventional manner. The inner disk 122 has a flat, annular peripheral surface 128 that radially opposes the annular shoulder surface 94 of the cowling. A close tolerance is provided between the annular peripheral surface 128 of the inner disk and the annular shoulder surface 94 of the cowling that functions as a sliding liquid seal between these two radially opposed surfaces. The outer disk 124 also has a flat, annular peripheral surface 132 that radially opposes the flat, annular shoulder surface 62 of the inlet cap 24. A close tolerance is also provided between these two radially opposed surfaces that functions as a sliding liquid seal between the two surfaces. An interior surface 134 of the inner disk 122 that opposes the outer disk 124 is generally flat adjacent the peripheral surface 128 of the disk but gradually tapers outwardly to a rounded cone apex 136 as the interior surface 134 extends to the center of the disk. The interior surface 138 of the outer disk 124 that opposes the inner disk 122 is also generally flat adjacent the peripheral surface 132 of the disk, but with the opposite exterior surface 142 of the outer disk 124 gradually curves away from the inner disk 122 as it extends to a circular center hole 144 in the outer disk. The center hole 144 communicates with the interior axial spacing between the two disks 122, 124. The center hole 144 is bounded by a flat, annular rim surface 146 that extends around the hole and axially opposes the flat, annular rim surface 58 on the inlet cap interior surface 56 that surrounds the inlet opening 54 of the inlet cap. The sliding engagement between the flat, annular rim 146 surrounding the center hole 144 of the outer disk 124 and the flat, annular rim surface 58 surrounding the inlet opening 54 of the inlet cap 24 functions as a liquid seal between these two surfaces. A plurality of impeller vanes 148 are provided between the impeller inner disk 122 and the impeller outer disk 124. The vanes 148 are circumferentially arranged around the outer disk center hole 144 and curve as they extend radially from inner ends or leading edges 152 of the vanes to outer ends 154 of the vanes. The vane inner ends or leading edges 152 are positioned adjacent the outer disk center hole 144 and the vane outer ends 154 are positioned adjacent the peripheral surfaces 128, 132 of the inner disk and outer disk. In alternate embodiments, the liquid seal provided by the opposed rim surface 58 of the inlet cap and the rim surface 146 of the impeller outer disk 124 could be replaced with other types of seals between the inlet cap and impeller, for example a labyrinth seal or a hydrodynamic seal. In addition, the impeller could be constructed without the outer disk 124 where the inlet cap interior surface 56 is in close proximity to the impeller blade vanes 148.

The deep well submersible pump 12 of the invention is used in the conventional manner. The pump 12 is connected to the bottom of a series of interconnected downpipes and is lowered into the well through the well liners 14 until submerged in the liquid contained in the well. On operation of the electric motor 28, the impeller 34 is rotated.

Rotation of the impeller 34 and the impeller vanes 148 draws liquid through the bottom end 16 of the downpipe and the center hole 144 of the outer disk 124 into the axial spacing between the inner disk 122 and the outer disk 124. Rotation of the impeller 34 pushes or forces the liquid radially outward toward the flow path defined between the cowling exterior surface 96 and the inlet cap interior surface 56 and housing side wall interior surface 38. As the liquid enters the flow path, it is first directed radially outwardly between the cowling exterior surface 96 and the peripheral portion 64 of the inlet cap interior surface. The curvature of these two surfaces redirects the flow of liquid from a radially outward direction to an axial direction toward the annular channel 84 between the motor 28 and housing side wall 22. The liquid flow is directed through the plurality of deswirler blades 112 that turn the flow of liquid around the cowling exterior surface 96 to an axial direction of the flow. The flow of liquid is directed through the radially expanding area between the axial portion 102 of the cowling exterior surface 96 and the housing side wall interior surface 38 and past the cowling rearward edge 104 into the annular channel 84 between the motor casing exterior surface 82 and the housing side wall interior surface 38. Diffusion of the liquid flow takes place due to the increasing flow area between the slanting axial portion of the cowling exterior surface 96 and the housing side wall interior surface 38. The flow of liquid continues through the annular channel until it reaches the outlet cap 26 at the opposite end of the housing side wall 22 where it is discharged through the outlet opening 74. The impeller and diffuser of the pump 12 enable the pump to operate as a single stage pump. The simplified construction of the pump reduces assembly time and its costs, as well as reducing material costs. The simplified construction is also much lighter than prior art deep well submersible pumps, enabling the submersible pump 12 of the invention to be used with plastic downpipes which also reduces the overall weight of the pump assembly.

While the present invention has been described by reference to a specific embodiment, it should be understood that modifications and variations of the invention may be constructed without departing form the scope of the invention defined in the following claims.

What is claimed:

1. A submersible pump comprising:

a cylindrical side wall having opposite exterior and interior surfaces, the interior surface surrounding an interior volume of the pump, the interior volume having a center axis defining mutually perpendicular axial and radial directions relative to the pump and the side wall having axially opposite inlet and outlet ends;

an inlet cap at the inlet end of the side wall, the inlet cap having an inlet opening and an interior surface that faces toward the pump interior volume, a peripheral portion of the inlet cap interior surface extending radially away from the inlet opening and curving toward the pump interior volume and then extending axially and merging with the side wall interior surface as a continuous surface;

an electric motor in the pump interior volume, the electric motor having a motor casing with an exterior surface and a motor shaft projecting from the motor casing toward the inlet cap inlet opening, the motor casing exterior surface being spaced radially inward from the side wall interior surface defining an annular channel between the motor casing exterior surface and the side wall interior surface;

a cowling in the pump interior volume and mounted on the motor, the cowling surrounding the motor and motor shaft and having an exterior surface that is spaced axially from the peripheral portion of the inlet cap interior surface and is spaced radially from the side wall interior surface whereby the cowling exterior surface and the peripheral portion of the inlet cap interior surface and the side wall interior surface define an annular flow path that is first directed radially outwardly between the cowling exterior surface and the peripheral portion of the inlet cap interior surface and then curves and is directed axially between the cowling exterior surface and the side wall interior surface to the annular channel between the side wall interior surface and the motor casing exterior surface.

2. The pump of claim 1, further comprising:

an impeller mounted on the motor shaft, the impeller having a plurality of vanes, each vane having an inner end adjacent the inlet opening of the inlet cap and a radially opposite outer end adjacent the peripheral portion of the inlet cap interior surface whereby rotation of the motor shaft and impeller draws liquid through the inlet opening of the inlet cap and pushes the liquid radially outward across the peripheral portion of the inlet cap interior surface thereby redirecting a flow of liquid through the pump interior volume from a radial flow direction to an axial flow direction through the channel between the motor casing exterior surface and the side wall interior surface.

3. The pump of claim 1, further comprising:

the plurality of blades are circumferentially spaced around the side wall interior surface and each blade has a leading edge oriented in a generally circumferential direction adjacent the inlet cap and an axially opposite trailing edge oriented in a generally axial direction.

4. The pump of claim 3, further comprising:

each blade contacts across the side wall interior surface as the blade extends from the blade leading edge to the blade trailing edge.

5. A submersible pump comprising:

a cylindrical side wall having opposite exterior and interior surfaces, the interior surface surrounding an interior volume of the pump, the interior volume having a center axis defining mutually perpendicular axial and radial directions relative to the pump and the side wall having axially opposite inlet and outlet ends;

an inlet cap at the inlet end of the side wall, the inlet cap having an inlet opening and an interior surface that faces toward the pump interior volume, a peripheral portion of the inlet cap interior surface extending radially away from the inlet opening and curving toward the pump interior volume and then extending axially and merging with the side wall interior surface as a continuous surface; and, a plurality of blades projecting radially inward from the side wall interior surface.

6. A submersible pump comprising:

a cylindrical side wall having opposite exterior and interior surfaces, the interior surface surrounding an interior volume of the pump, the interior volume having a center axis defining mutually perpendicular axial and radial directions relative to the pump and the side wall having axially opposite inlet and outlet ends;

an inlet cap at the inlet end of the side wall, the inlet cap having an inlet opening and an interior surface that faces towards the pump interior volume, a peripheral portion of the inlet cap interior surface extending radially away from the inlet opening and curving toward the pump interior volume and then extending axially and merging with the side wall interior surface as a continuous surface;

an electric motor in the pump interior volume, the electric motor having a motor casing with an exterior surface and a motor shaft projecting from the motor casing toward the inlet cap inlet opening, the motor casing exterior surface being spaced radially inward from the side wall interior surface defining an annular channel between the motor casing exterior surface and the side wall interior surface;

an impeller mounted on the motor shaft, the impeller having a plurality of vanes, each vane having an inner end adjacent the inlet opening of the inlet cap and a radially opposite outer end adjacent the peripheral portion of the inlet cap interior surface whereby rotation of the motor shaft and impeller draws liquid through the inlet opening of the inlet cap and pushes the liquid radially outward across the peripheral portion of the inlet cap interior surface thereby redirecting a flow of liquid through the pump interior volume from a radial flow direction to an axial flow direction through the channel between the motor casing exterior surface and the side wall interior surface; and, a cowling in the pump interior volume and mounted on the motor, the cowling surrounding the motor and motor shaft and having an exterior surface that is spaced axially from the peripheral portion of the inlet cap interior surface and is spaced radially from the side wall interior surface whereby the cowling-exterior surface and the peripheral portion of the inlet cap interior surface and the side wall interior surface define an annular flow path that is first directed radially outwardly between the cowling exterior surface and the peripheral portion of the inlet cap interior surface and then curves and is directed axially between the cowling exterior surface and the side wall interior surface to the annular channel between the side wall interior surface and the motor casing exterior surface.

7. The pump of claim 6, further comprising:

a plurality of blades connecting the side wall interior surface with the cowling exterior surface.

8. The pump of claim 7, further comprising:

the plurality of blades are circumferentially spaced around the side wall interior surface and each blade has a leading edge oriented in a generally circumferential direction adjacent the inlet cap and an axially opposite trailing edge oriented in a generally axial direction.

9. The pump of claim 8, further comprising:

each blade contacts the side wall interior surface and the cowling exterior surface as the blade extends from the blade leading edge to the blade trailing edge.

10. The pump of claim 6, further comprising:

the impeller has an axially outer disk adjacent the inlet cap and an axially inner disk adjacent the motor shaft, the plurality of vanes extend radially between the outer disk and the inner disk, the inner disk has an annular peripheral surface; and, the cowling has an annular shoulder surface adjacent the inlet cap and the shoulder surface opposes the inner disk peripheral surface.

11. A submersible pump comprising;

a cylindrical side wall having opposite exterior and interior surfaces, the interior surface surrounding an interior volume of the pump, the interior volume having a center axis defining mutually perpendicular axial and radial directions relative to the pump and the side wall having axially opposite inlet and outlet ends;

an inlet cap at the inlet end of the side wall, the inlet cap having an inlet opening and an interior surface that faces toward the pump interior volume, a peripheral portion of the inlet cap interior surface extending radially away from the inlet opening and curving toward the pump interior volume and then extending axially and merging with the side wall interior surface as a continuous surface;

an electric motor in the pump interior volume, the electric motor having a motor casing with an exterior surface and a motor shaft projecting from the motor casing toward the inlet cap inlet opening, the motor casing exterior surface being spaced radially inward from the side wall interior surface defining an annular channel between the motor casing exterior surface and the side wall interior surface;

an impeller mounted on the motor shaft, the impeller having a plurality of vanes, each vane having an inner end adjacent the inlet opening of the inlet cap and a radially opposite outer end adjacent the peripheral portion of the inlet cap interior surface whereby rotation of the motor shaft and impeller draws liquid through the inlet opening of the inlet cap and pushes the liquid radially outward across the peripheral portion of the inlet cap interior surface thereby redirecting a flow of liquid through the pump interior volume from a radial flow direction to an axial flow direction through the channel between the motor casing exterior surface and the side wall interior surface;

the impeller has an axially outer disk adjacent the inlet cap and an axially inner disk adjacent the motor shaft, the plurality of vanes extend radially between the outer disk and the inner disk, the outer disk has a center hole with a rim surface that is aligned with the inlet opening of the inlet cap; and, the inlet opening has a rim surface that is in sliding engagement with the outer disk rim surface providing a liquid seal between the inlet opening rim surface and the outer disk rim surface.

12. A submersible pump comprising;

a cylindrical side wall having opposite exterior and interior surfaces, the interior surface surrounding an interior volume of the pump, the interior volume having a center axis defining mutually perpendicular axial and radial directions relative to the pump and the side wall having axially opposite inlet and outlet ends;

an inlet cap at the inlet end of the side wall, the inlet cap having an inlet opening and an interior surface that faces toward the pump interior volume, a peripheral portion of the inlet cap interior surface extending radially away from the inlet opening and curving toward the pump interior volume and then extending axially and merging with the side wall interior surface as a continuous surface;

an electric motor in the pump interior volume, the electric motor having a motor casing with an exterior surface and a motor shaft projecting from the motor casing toward the inlet cap inlet opening, the motor casing exterior surface being spaced radially inward from the side wall interior surface defining an annular channel between the motor casing exterior surface and the side wall interior surface;

an impeller mounted on the motor shaft, the impeller having a plurality of vanes, each vane having an inner end adjacent the inlet opening of the inlet cap and a radially opposite outer end adjacent the peripheral portion of the inlet cap interior surface whereby rotation of the motor shaft and impeller draws liquid through the inlet opening of the inlet cap and pushes the liquid radially outward across the peripheral portion of the inlet cap interior surface thereby redirecting a flow of liquid through the pump interior volume from a radial flow direction to an axial flow direction through the channel between the motor casing exterior surface and the side wall interior surface;

the impeller has an axially outer disk adjacent the inlet cap and an axially inner disk adjacent the motor shaft, the plurality of vanes extend radially between the outer disk and the inner disk, the outer disk has an annular peripheral surface; and the inlet cap has an annular shoulder surface that opposes the outer disk peripheral surface.

13. The pump of claim 12, further comprising:

the peripheral portion of the inlet cap interior surface is positioned radially outward from the inlet cap shoulder surface.

14. A submersible pump comprising:

a cylindrical side wall having opposite exterior and interior surfaces, the interior surface surrounding an interior volume of the pump, the interior volume having a center axis defining mutually perpendicular axial and radial directions relative to the pump and the side wall having axially opposite inlet and outlet ends;

an inlet cap at the inlet end of the side wall, the inlet cap having an inlet opening, an interior surface that faces toward the pump interior volume and an annular shoulder surface on the interior surface; and an impeller having an axially outer disk adjacent the inlet cap and an axially inner disk with a plurality of radially extending vanes between the outer disk and inner disk, the outer disk has a center hole that is aligned with the inlet cap inlet opening and the outer disk has an annular peripheral surface that is positioned radially inward and opposing the inlet cap shoulder surface.

15. The pump of claim 14, further comprising:

the inlet cap has a rim surface around the inlet opening and the outer disk has an annular rim surface around the outer disk center hole that is in sliding engagement with the inlet cap rim surface.

16. The pump of claim 14, further comprising:

a peripheral portion of the inlet cap interior surface extends radially outward from the shoulder surface and curves toward the pump interior volume and then extends axially and merges with the side wall interior surface as a continuous surface.

17. The pump of claim 14, further comprising:

an electric motor in the pump interior volume, the electric motor having a motor casing with an exterior surface and a motor shaft projecting from the motor casing toward the inlet cap inlet opening, the motor casing exterior surface being spaced radially from the side wall interior surface defining an annular channel between the motor casing exterior surface and the side wall interior surface; and a cowling mounted on the motor in the pump interior volume, the cowling surrounding the motor and the motor shaft and having an exterior surface that is spaced axially from the inlet cap interior surface and is spaced radially from the side wall interior surface whereby the cowling exterior surface and the inlet cap and side wall interior surfaces define an annular flow path that is first directed radially outward between the cowling exterior surface and the inlet cap interior surface and then turns and is directed axially between the cowling exterior surface and the side wall interior surface to the annular channel between the side wall interior surface and the motor casing exterior surface.

18. The pump of claim 17, further comprising:

the inner disk has an annular peripheral surface and;

the cowling has an annular shoulder surface adjacent the inlet cap and the shoulder surface is positioned radially outward of and opposing the inner disk peripheral surface.

19. The pump of claim 14, further comprising:

a plurality of blades projecting radially inward from the side wall interior surface.

20. The pump of claim 19, further comprising:

the plurality of blades are circumferentially spaced around the side wall interior surface and each blade has a leading edge adjacent the end cap and an axially opposite trailing edge.

21. The pump of claim 20, further comprising:

each blade contacts the side wall interior surface as the blade extends from the blade leading edge to the blade trailing edge.

22. The pump of claim 17, further comprising:

a plurality of blades connecting the side wall interior surface with the cowling exterior surface.

23. The pump of claim 22, further comprising:

the plurality of blades are circumferentially spaced around the side wall interior surface and each blade has a leading edge oriented in a generally circumferential direction adjacent the end cap and an axially opposite trailing edge oriented in a generally axial direction.

24. The pump of claim 23, further comprising:

each blade contacts the side wall interior surface and the cowling exterior surface as the blade extends from the blade leading edge to the blade trailing edge.

25. A submersible pump comprising:

a cylindrical side wall having opposite exterior and interior surfaces, the interior surface surrounding an interior volume of the pump, the interior volume having a center axis defining mutually perpendicular axial and radial directions relative to the pump and the side wall having axially opposite inlet and outlet ends;

an inlet cap at the side wall inlet end, the inlet cap having an inlet opening and an interior surface that faces toward the pump interior volume; and a cowling having an exterior surface that is axially spaced from the inlet cap interior surface and is radially spaced from the side wall interior surface with the radial spacing between the cowling exterior surface and the side wall interior surface becoming larger as the cowling and side wall extend axially away from the inlet cap, whereby the cowling exterior surface and the inlet cap and side wall interior surfaces define an annular flow path through the pump from the inlet opening to the side wall outlet end, where liquid directed through the flow path is first directed radially outward between the cowling exterior surface and the inlet cap interior surface and then turns around the cowling and is directed axially between the cowling exterior surface and the side wall interior surface.

26. The pump of claim 25, further comprising:

an electric motor in the pump interior volume, the electric motor having a motor casing with an exterior surface and a motor shaft projecting from the motor toward the inlet cap inlet opening, the motor casing exterior surface being spaced radially from the side wall interior surface defining an annular channel between the motor casing exterior surface and the side wall interior surface.

27. The pump of claim 26, further comprising:

an impeller mounted on the motor shaft, the impeller having a plurality of radially extending vanes with each vane having an inner end adjacent the inlet opening of the inlet cap and a radially opposite outer end adjacent the flow path whereby rotation of the motor shaft and impeller draws liquid through the inlet cap inlet opening and pushes the liquid through the flow path.

28. The pump of claim 25, further comprising:

a plurality of blades projecting radially inward from the side wall interior surface.

29. The pump of claim 28, further comprising:

the plurality of blades are circumferentially spaced around the side wall interior surface and each blade has a leading edge oriented in a generally circumferential direction adjacent the inlet cap and an axially opposite trailing edge oriented in a generally axial direction.

30. The pump of claim 24, further comprising:

each blade contacts the side wall interior surface as the blade extends from the blade leading edge to the blade trailing edge.

31. The pump of claim 25, further comprising:

a plurality of blades connecting the side wall interior surface with the cowling exterior surface.

32. The pump of claim 31, further comprising:

the plurality of blades are circumferentially spaced around the side wall interior surface and each blade has a leading edge adjacent the inlet cap and an axially opposite trailing edge.

33. The pump of claim 32, further comprising:

each blade contacts the side wall interior surface and the cowling exterior surface as the blade extends from the blade leading edge to the blade trailing edge.

34. The pump of claim 27, further comprising:

the impeller has an axially outer disk adjacent the inlet cap and an axially inner disk adjacent the motor shaft, the plurality of vanes extend radially between the outer disk and the inner disk, the outer disk has an annular peripheral surface; and the inlet cap has an annular shoulder surface that opposes the outer disk peripheral surface.

35. The pump of claim 27, further comprising:

the impeller has an axially outer disk adjacent the inlet cap and an axially inner disk adjacent the motor shaft, the plurality of vanes extend radially between the outer disk and the inner disk, the inner disk has an annular peripheral surface; and, the cowling has an annular shoulder surface adjacent the inlet cap and the shoulder surface opposes the inner disk peripheral surface.

* * * * *